United States Patent [19]

Richards

[11] Patent Number: 4,820,230

[45] Date of Patent: Apr. 11, 1989

[54] TOSSING RING AND SAUCER

[76] Inventor: Marvin D. Richards, 418 Del Sol, Pleasanton, Calif. 94566

[21] Appl. No.: 181,746

[22] Filed: Apr. 14, 1988

Related U.S. Application Data

[63] Continuation of Ser. No. 1,169, Jan. 6, 1987, abandoned.

[51] Int. Cl.[4] ..... A63H 27/00; A63B 71/09

[52] U.S. Cl. ..... 446/48; 446/46

[58] Field of Search ..... 446/46–48; 273/424, 425, 428, 426, 336

[56] References Cited

U.S. PATENT DOCUMENTS

| | | | |
|---|---|---|---|
| 1,480,563 | 1/1924 | Morgan . | |
| 3,312,472 | 4/1967 | Kerr | 446/48 X |
| 3,363,899 | 1/1968 | Gross . | |
| 3,594,945 | 7/1971 | Turney . | |
| 3,710,505 | 1/1973 | Linefelser . | |
| 3,802,704 | 3/1974 | Genua . | |
| 4,114,885 | 9/1978 | Morrow | 273/424 |
| 4,176,843 | 12/1979 | DeWitt, Jr. | 273/424 X |
| 4,334,385 | 6/1982 | Melin et al. | 446/46 |
| 4;479,655 | 10/1984 | Adler . | |
| 4,560,358 | 12/1985 | Adler | 446/46 |

OTHER PUBLICATIONS

Cater, Feb. 23, 1888, No. 2678, (drawing only).

*Primary Examiner*—Mickey Yu
*Attorney, Agent, or Firm*—Bielen & Peterson

[57] ABSTRACT

A tossing ring which is particularly useful in the playing of having an annular body constructed of lightweight foam material. The annular body includes a plurality of flat surfaces on the outer surface of the annulus. Also, included in the annular body is an upper surface and a parallel bottom surface. A pair of side surfaces are also provided and are substantially perpendicular to the upper and lower surfaces. A pair of mitred surfaces interrupt the connection of the upper surface and the outer side surface, as well as the lower surface and the inner side surface.

6 Claims, 2 Drawing Sheets

TOSSING RING AND SAUCER

This is a continuation of application Ser. No. 001,169 filed Jan. 6, 1987, abandoned.

BACKGROUND OF THE INVENTION

The present invention relates to a novel and useful tossing ring which is particularly useful as a toy.

Rings have been employed in the past as an object to be used in tossing type games. For example U.S. Pat. No. 1,480,563 employs rubber rings which are tossed onto a pole. Aerodynamic toys have also been constructed in circular configurations to be used as boomerangs. For example U.S. Pat. Nos. 3,594,945 and 4,479,655 describe this type of flying toy. In addition, toys having aerodynamic ability have been constructed of soft foam material, which is particularly useful for indoor use as is shown by U.S. Pat. No. 3,710,505.

Rings constructed of soft foam material have also been devised in the past. For example, U.S. Pat. No. 3,363,899 describes a disc having a central opening. Such discs are launched into a cup. U.S. Pat. No. 3,802,704 shows soft foam rings of square cross-sectional configuration which are used in the game of quoits.

A tossing ring constructed of lightweight foam material which exhibits aerodynamic ability particularly suited for placement of the ring over a projecting object, would be an advance in the field of toys and games.

SUMMARY OF INVENTION

In accordance with the present invention a novel and useful tossing ring is provided.

The tossing ring of the present invention employs an annular body which is constructed of lightweight foam material. The annular body has a flattened upper surface and a flattened outer side surface, when viewed in section. The flattened upper and outer side surfaces are disposed substantially orthogonally relative to one another. A first flattened mitred surface interposes the upper and outer surfaces.

A bottom flattened surface is also provided and is placed substantially parallel to the flattened upper surface. Further, a flattened inner side surface lies substantially parallel to the flattened outer side surface. A second flattened mitred surface spans the inner side surfaces and the flattened bottom surface. The upper, outer side, first and second mitred, and bottom surfaces of the annular body extend completely around the same.

The first mitred surface may possess a width across the annular body which is greater than the width of the outer side surfaces of the annular body. In another embodiment, the first mitred surface and the outer side surface may possess widths which are substantially equal to one another.

The annular body may include a split member having a first section and a second section. A flexible gasket may be interposed the first and second sections and be held in sandwich fashion between the first and second sections to form a unit.

In addition, an insert having a flat upper surface and side portion depending therefrom may be press fitted against the inner side surface of the annular body to form a unit.

Moreover, a flat flexible plate may extend across the opening of the ring and be fixed to the upper surface of the annular body or sandwiched between first and second sections of the annular body.

It may be apparent that a novel and useful tossing ring has been described.

It is an object of the present invention to provide a tossing ring which is particularly useful in a game resembling quoits.

It is another object of the present invention to provide a tossing ring which has a aerodynamic characteristic which causes it to stall after a generally horizontal flight and descend vertically along a line substantially perpendicular to the plane of the body of the tossing ring.

A further object of the present invention is to provide tossing ring which is suitable for indoor use and is constructed of soft lightweight material, in this regard.

A further object of the present invention is to provide a tossing ring which may be converted into a flying disc with minor modifications.

The invention possesses other objects and advantages especially as concerns particular characteristics and features thereof which will become apparent as the specification continues.

BRIEF DESCRIPTION OF THE DRAWINGS

FIG. 6 is a sectional view depicting another embodiment of the invention.

Figure 1:
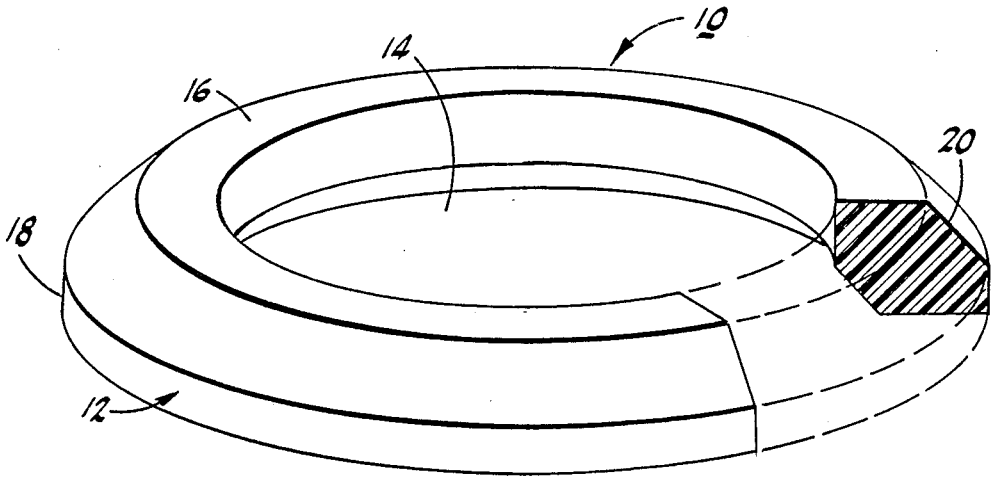
FIG. 1 is a top perspective view of the tossing ring of the present invention having a portion depicted in phantom to reveal the cross sectional configuration of the tossing ring.

For a better understanding of the invention reference is made to the following detailed description of the preferred embodiments of the present invention which should be referenced to the hereinabove described drawings.

DESCRIPTION OF THE PREFERRED EMBODIMENTS

Various aspects of the present invention will evolve from the following detailed description which should be taken in conjunction with the prior described drawings.

The invention as a whole is shown in its entirety by reference character 10. Alternate embodiments and portions of the present invention 10 are noted by the reference character 10 followed by a letter of the alphabet.

Figure 2:
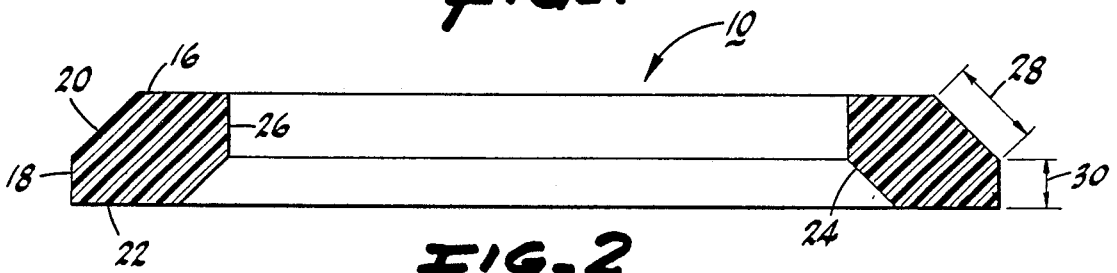
FIG. 2 is a sectional view of the embodiment of the invention depicted in FIG. 1.

The tossing ring 10, FIGS. 1 and 2, includes an annular body 12 forming a central opening 14 which is substantially circular, in the present case. Annular body 12 may be constructed of lightweight foam material such as polyester foam, polyurethane foam, and the like. It is believed that a polyurethane foam employed in the construction of annular body 12 possesses a density ranging from 1–6 lb/ft$^3$.

Annular body 12 includes a flattened upper surface 16 and a flattened outer side surface 18. The upper surface 16 and outer side surface 18 are disposed substantially orthogonally relative to one another. A first flattened mitred surface 20 interposes the upper and outer side surfaces. With reference to FIG. 2 it may be seen that annular body 12 also is constructed with a flattened bottom surface 22 which is substantially parallel to upper surface 16. A second mitred surface 24 spans bottom surface 22 and flattened inner side surface 26. Upper surface 16, outer side surface 18, first mitred surface 20, bottom surface 22, second mitred surface 24 and inner side surface 26 extend completely around annular body 12 in a closed path.

As depicted in FIG. 2, first mitred surface 20 possesses a width greater than outer side surface 18, per spanning arrows 28 and 30 respectively.

Figure 3:
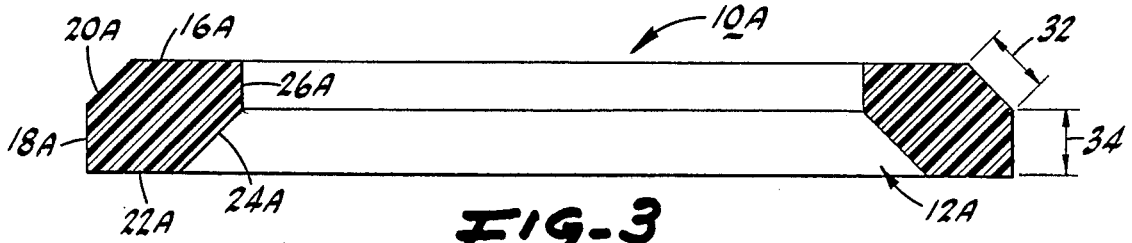
FIG. 3 is a sectional view of another embodiment of the present invention.

Another embodiment of the tossing ring 10A shown in FIG. 3, includes upper surface 16A, outer side surface 18A, first mitred surface 20A, bottom surface 22A, inner side surface 26A and second mitred surface 24A, in the same general relationship as the embodiment shown in FIGS. 1 and 2. However, the width of first mitred surface 20A is substantially equal to the width of outer side surface 18A, as depicted by spanning arrows 32 and 34.

Figure 4:
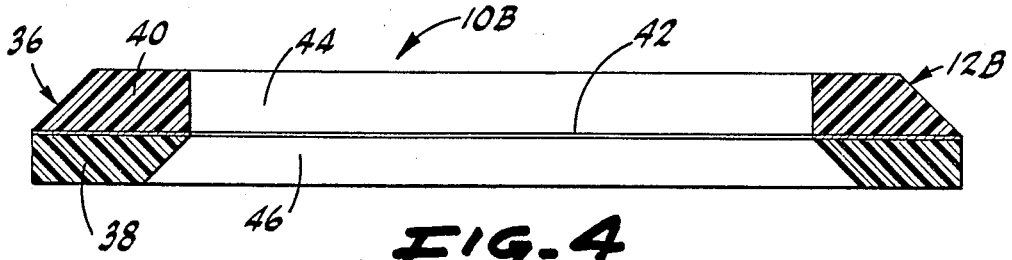
FIG. 4 is a sectional view of another embodiment of the present invention.

In FIG. 4, an embodiment 10B of the present invention is depicted and includes a split member 36 having first section 38 and second section 40. A flexible gasket 42 is sandwiched between first and second section 38 and 40 and held thereto by friction fitting, or mastic (not shown). Flexible gasket 42 would be constructed of non-foam material such as paper, plastic, wood and the like. Flexible gasket 42 would possess relative shear strength and divide central opening 14 to cavities 44 and 46. Embodiment 10B of the present invention would also include external surfaces in the same relationship generally, as in embodiment 10 of FIGS. 1 and 2.

Figure 5:
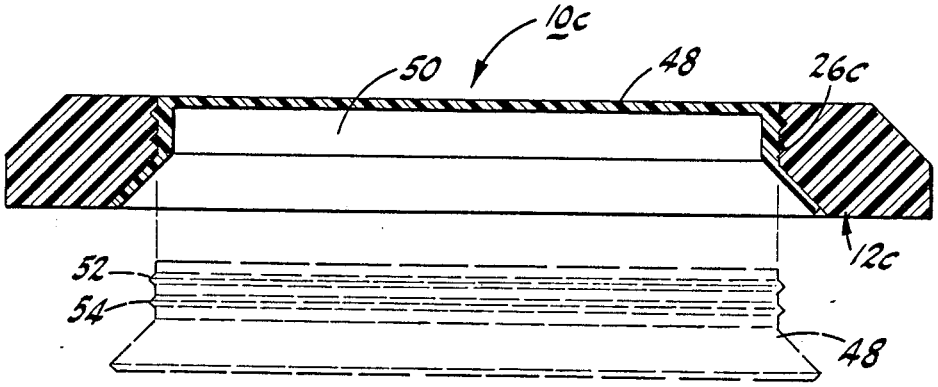
FIG. 5 is a sectional view of another embodiment of the present invention showing an insert in phantom.

FIG. 5 depicts another embodiment of the present invention in which an annular body 12C constructed of soft foam material includes external surfaces substantially similar to the embodiment 10 of FIGS. 1 and 2. However, an insert 48 constructed of rigid plastic material may be friction-fitted within central opening 14 to form cavity 50. Insert 48 includes external ridges 52 and 54 which aid in the gripping of insert 48 to annular body 12C. This occurs specifically at inner side surface 26C. Thus, the embodiment 10C takes the form of a flying disc, with annular body 12C serving as a soft foam rim.

Figure 6:
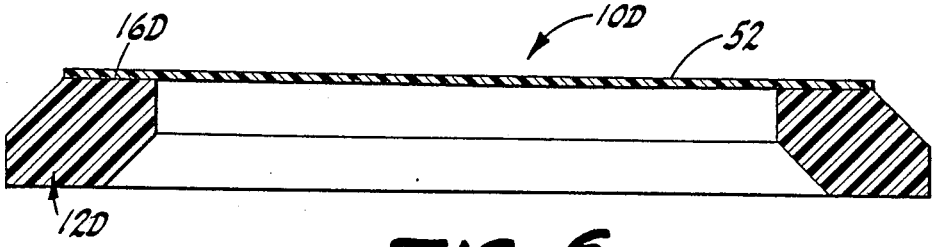
FIG. 6 is a sectional view of another embodiment of the present invention.
Figure 7:
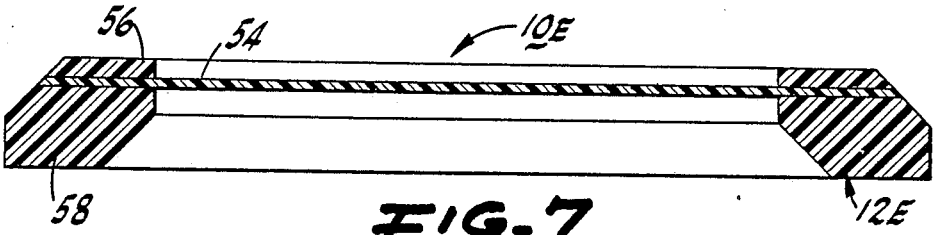
FIG. 7 is a sectional view of another embodiment of the present invention.

FIGS. 6 and 7 show embodiments 10D and 10E of the present invention where a relatively rigid circular plastic plate 52 spans central opening 14. Plate 52 may be affixed to the upper surface 16D of annular body 12D by adhesive or other fastening means. FIG. 7 depicts plate 54 being affixed between first section 56 and second section 58 of annular body 12E. AGain, plate 54 may be friction-fitted or affixed by mastic or other fastening means to form a flying disc unit. It should be noted, that the outer surfaces of annular bodies 12D and 12E are substantially in the same relationship as the outer surface as shown in annular body 12 of FIGS. 1 and 2.

Figure 8:
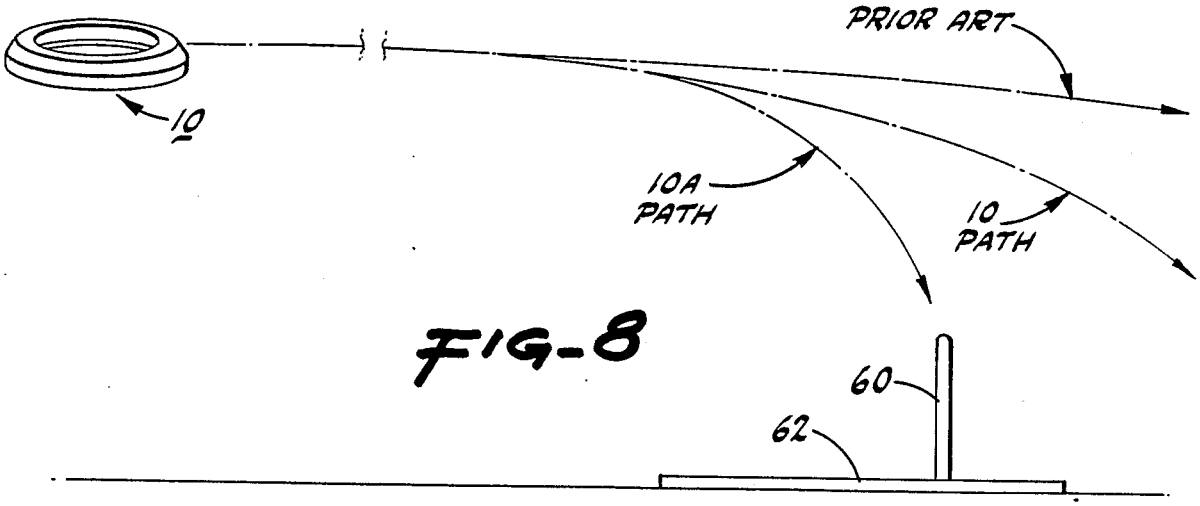
FIG. 8 is a perspective view showing the device of FIGS. 1 and 2 in use and the flight path of the prior art devices.

In operation, the user grasps the ring 10 in any one of the embodiments 10, 10A, 10B, 10C, 10D or 10E FIGS. 1–7 and scales the same horizontally. FIG. 8 depicts the flight path of embodiments 10 and 10A. It has been observed that the rings depicted in FIGS. 1–3 stall after a limited horizontal flight and descend rapidly in a vertical direction. This characteristic is particularly useful in tossing rings 10 and 10A over post 60 held to platform 62. The prior art flight path of FIG. 8 depicts a tossing ring lacking the mitred surfaces 20 and 24 of the present invention.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A tossing ring, comprising:

an annular body constructed of light weight foam material, said annular body including, when viewed in section, a flattened upper surface and a flattened outer side surface, said flattened upper and outer side surfaces being disposed substantially orthogonally relative to one another; a first flattened mitred surface interposed between said upper and outer side surfaces; a flattened bottom surface disposed substantially parallel to said flattened upper surface; and a flattened inner side surface disposed substantially parallel to said flattened outer side surface; and a second mitred surface interposed said flattened inner side surface and said flattened bottom surface;

said flattened bottom surface, said flattened upper surface, said flattened outer side surface, said flattened first mitred surface, said flattened inner side surface, and said flattened second mitred surface being interconnected to extend completely around and form the exterior surface of said annular body.

2. The tossing ring of claim 1 in which said first mitred surface possesses a linear dimension across said annular body, which is greater than the linear dimension of said outer side surface of said annular body.

3. The tossing ring of claim 1 in which said annular body comprises a split member having a first section and a second section, and further comprises a flexible gasket interposed between said first and second sections, and means for holding said first section, said second section and said gasket as a unit.

4. The tossing ring of claim 1 which further comprises an insert having a flattened upper surface and a side portion depending therefrom, said depending side portion capable of being fitted against said inner side surface of said annular body to form a unit.

5. The tossing ring of claim 1 which further comprises a flattened flexible plate and means for fixing said plate to the upper surface of said annular body to form a unit.

6. The tossing ring of claim 1 in which said annular body comprises a split member having a first section and a second section, and further comprises a flexible plate interposed between said first and second sections, and means for holding said first and second sections and said flexible plate as a unit.

* * * * *